US008282303B2

(12) United States Patent
Umeno et al.

(10) Patent No.: US 8,282,303 B2
(45) Date of Patent: Oct. 9, 2012

(54) LIQUID APPLICATOR

(75) Inventors: Takashi Umeno, Fujioka (JP); Mitsuru Endou, Fujioka (JP); Tetsuaki Akaishi, Fujioka (JP); Hiroaki Koyama, Fujioka (JP)

(73) Assignee: Mitsubishi Pencil Co., Ltd., Shinagawa-Ku, Tokyo (JP)

( * ) Notice: Subject to any disclaimer, the term of this patent is extended or adjusted under 35 U.S.C. 154(b) by 797 days.

(21) Appl. No.: 12/280,711

(22) PCT Filed: Mar. 6, 2007

(86) PCT No.: PCT/JP2007/054236

§ 371 (c)(1),
(2), (4) Date: Aug. 26, 2008

(87) PCT Pub. No.: WO2007/102477

PCT Pub. Date: Sep. 13, 2007

(65) Prior Publication Data

US 2010/0232866 A1 Sep. 16, 2010

(30) Foreign Application Priority Data

Mar. 7, 2006 (JP) ..... 2006-061190

(51) Int. Cl.
*B43K 1/06* (2006.01)

(52) U.S. Cl. ..... 401/265

(58) Field of Classification Search ..... 401/265, 401/266, 171–174, 176, 177, 179, 182
See application file for complete search history.

(56) References Cited

U.S. PATENT DOCUMENTS

| | | | | |
|---|---|---|---|---|
| 2,442,503 | A * | 6/1948 | Melnikoff | 132/320 |
| 3,825,021 | A * | 7/1974 | Seidler | 132/320 |
| 7,201,526 | B2 * | 4/2007 | Tani | 401/266 |
| 7,309,185 | B2 * | 12/2007 | Thorpe et al. | 401/277 |
| 7,857,538 | B2 * | 12/2010 | Nasu et al. | 401/265 |
| 2008/0107472 | A1 | 5/2008 | Nasu et al. | |

FOREIGN PATENT DOCUMENTS

JP T15-24040 U 3/1926

(Continued)

OTHER PUBLICATIONS

PCT/ISA/210 (International Search Report).

(Continued)

*Primary Examiner* — Huyen Le
(74) *Attorney, Agent, or Firm* — Buchanan Ingersoll & Rooney PC

(57) ABSTRACT

A liquid applicator 1 is provided with a liquid pressing mechanism (liquid pressing means) 6 for pressurizing an application liquid 4 within a main body 2, and supplies an applying part 10 at a front end of the main body with the application liquid 4 by pressing of the liquid pressing mechanism 6, wherein the applying part 10 is made of an elastic material, is formed with a communication channel 24 for connecting inside and outside of the main body, and is provided with an application portion 10*a* so as to further protrude to the front side from an ejection port 24*a* of the communication channel 24, and in the application portion 10*a*, a portion 3 (mm) from a front end thereof has a vertical-direction repulsion force of 0.01 to 1.40 (N), resulting that it is possible to provide a liquid applicator with an appropriate hardness and bending elastic force, having no application unevenness and good application characteristics.

2 Claims, 13 Drawing Sheets

FOREIGN PATENT DOCUMENTS

| | | | |
|---|---|---|---|
| JP | 61-67621 | U | 5/1986 |
| JP | 63-39477 | U | 3/1988 |
| JP | 2603088 | Y2 | 12/1999 |
| JP | 3081834 | B | 7/2000 |
| JP | 2002-010829 | A | 1/2002 |
| JP | 2002-067568 | A | 3/2002 |
| JP | 3109917 | U | 4/2005 |
| JP | 2006-123305 | A | 5/2006 |
| JP | 2006-158949 | A | 6/2006 |
| WO | WO 2006/051646 | A1 | 5/2006 |

OTHER PUBLICATIONS

Notification of Transmittal of Translation of the International Preliminary Report on Patentability (Form PCT/IB/338), International Preliminary Report on Patentability (Form PCT/IB/373), Written Opinion of the International Search Authority (Form PCT/ISA/237) mailed in corresponding International Patent Application No. PCT/JP2007/054236, Sep. 18, 2008, The International Bureau of WIPO, Geneva, CH.

* cited by examiner

FIG. 5

AVERAGE VALUE OF n=3

UNIT [N]

| EXAMPLES | | WEIGHT AT ○mm FROM FRONT END | | | FEELING OF USE | APPLICATION UNEVENNESS FOR EACH VISCOSITY | | |
|---|---|---|---|---|---|---|---|---|
| | | 1mm | 2mm | 3mm | | 1,000mPs | 10,000mPs | 100,000mPs |
| COMPARATIVE EXAMPLE 1 | Q100F | 1.4 | 1.8 | 2.1 | × | ×/× | ▲/× | △/▲ |
| COMPARATIVE EXAMPLE 2 | DATA 5 | 1.15 | 1.4 | 1.72 | × | ×/× | ▲/× | △/▲ |
| EXAMPLE 1 | DATA 4 | 0.94 | 1.14 | 1.39 | ▲ | ▲/× | ▲/▲ | △/△ |
| EXAMPLE 2 | NNT2005 | 0.7 | 0.9 | 1.1 | △ | ▲/× | ▲/▲ | ○/○ |
| EXAMPLE 3 | DATA 3 | 0.59 | 0.72 | 0.9 | △ | △/▲ | △/△ | ○/○ |
| EXAMPLE 4 | DATA 2 | 0.42 | 0.55 | 0.71 | ○ | △/△ | ○/△ | ○/○ |
| EXAMPLE 5 | PANDEX T8375 | 0.30 | 0.42 | 0.56 | ○ | △/△ | ○/△ | ◎/◎ |
| EXAMPLE 6 | T8375 THIN SPATULA | 0.23 | 0.29 | 0.38 | ○ | △/△ | ○/○ | ○/○ |
| EXAMPLE 7 | DATA 1 | 0.12 | 0.17 | 0.23 | ◎ | ○/△ | ◎/◎ | ○/○ |
| EXAMPLE 8 | SILICONE 50° (comp) | 0.06 | 0.08 | 0.11 | ◎ | ○/○ | ◎/◎ | △/△ |
| EXAMPLE 9 | ELASTOMER TRIAL MATERIAL | 0.003 | 0.005 | 0.010 | ○ | △/○ | ×/△ | ×/× |

RANG IN THE PRESENT INVENTION

EVALUATION REFERENCE IN FEELING OF USE

◎ : GOOD FEELING TO SKIN
○
△
▲
× : HARD FEELING

/

EVALUATION AT SPEED OF 150mm/sec

EVALUATION AT SPEED OF 50mm/sec

EVALUATION REFERENCE IN APPLICATION UNEVENNESS, REFER TO [FIG. 6] AND [FIG. 7]

(NON-ABSORBENT SURFACE (PLATE 3mm THICK))

Reference for Evaluation

LIQUID APPLICATOR

FIELD OF THE INVENTION

The present invention relates to a liquid applicator which is provided with liquid pressing means for pressurizing an application liquid within a main body, and feeds an applying part at the front end of the main body with the application liquid by pressing of the liquid pressing means, and particularly relates to a liquid applicator for applying an application liquid to a soft object to be applied such as skin and oral cavity.

DESCRIPTION OF THE RELATED ART

Conventionally, a liquid applicator for applying an application liquid such as cosmetics and a chemical liquid is provided with a liquid pressing mechanism or liquid pressing means, which has a piston for pressurizing the application liquid in an application liquid reservoir provided within the main body to store the application liquid in the main body and appropriately supply an applying part provided at the front end with the application liquid, and an advance mechanism thereof (refer to Japanese Patent No. 3081834: Patent Document 1, Japanese Utility Model Registration No. 2603088: Patent Document 2).

Moreover, an applying part of an applicator for cosmetics that is provided with an application spatula being projected frontward from a discharge port (an ejection port) of an application liquid is disclosed (Japanese Utility Model Application Laid-Open Sho 61 No. 67621: Patent Document 3), in which an application liquid for cosmetics is supplied to the application spatula from the discharge port and the application liquid is applied and spread with the application spatula being elastically deformed.

Moreover, an applicator for liquid cosmetics is proposed, that a main body of an application portion composed of a flexible silicone resin is provided with a contact surface so as to be inclined with respect to an outer end surface of the application portion (Japanese Utility Model Registration No. 3109917: Patent Document 4). In this applicator, the ejection port in the main body of the application portion is deformed with a pressure of pressurized and fed cosmetics to discharge the cosmetic liquid, and the flexible main body of the application portion provides comfortable contact feeling at the time of application and enables uniform spreading.

Patent Document 1: Japanese Patent No. 3081834

Patent Document 2: Japanese Utility Model Registration No. 2603088

Patent Document 3: Japanese Utility Model Application Laid-Open Sho 61 No. 67621

Patent Document 4: Utility Model Registration No. 3109917

SUMMARY OF THE INVENTION

Problems to be Solved by the Invention

However, in the aforementioned conventional liquid applicators, in a case where an applying part is hard and has so large bending elastic force, when a user applies an application liquid to a target portion, there is a problem that a desired application thickness is not obtained, including that an application unevenness is caused by scraping the applied application liquid, on the other hand, in a case where the applying part is so soft that bending elastic force lacks, there is a problem of usability, including that it is hard to move the applying part to an intended position with a front end thereof being pressed and slid, and that the application liquid can not be applied with an intended thickness (application thickness).

Against such circumstances, conventionally, an applying part which has excellent usability and less application unevenness has not been proposed.

Further, an applying part which has less application unevenness and excellent application characteristics even when an application liquid to be applied has a wide viscosity range has been desired, which has not been conventionally proposed.

The present invention has been made to solve such problems, and it is an object of the invention to provide a liquid applicator in which an applying part has an appropriate hardness and bending elastic force, having no application unevenness and excellent application characteristics.

Means to Solve the Problems

The present invention provides a liquid applicator which comprises liquid pressing means for pressurizing an application liquid within a main body, and supplies an applying part at a front end of the main body with the application liquid by pressing of the liquid pressing means, wherein the applying part is made of an elastic material, formed with a communication channel for connecting inside and outside of the main body, and is provided with an application portion further protruding to a front end from an ejection port of the communication path, and the application portion has a vertical-direction repulsion force of 0.01 to 1.40 (N) at a portion 3 (mm) from the front end.

Further, in the present invention, it is preferable that in the application portion of the applying part, a distance L from the ejection port to the front end is within a dimension range of $1 \leqq L \leqq 20$ (mm), and a width W from the ejection port to the front end is within a dimension range of $2.5 \leqq W \leqq 20$ (mm).

Further, in the present invention, it is preferable that the applying part is made of a transparent or translucent material so that an application liquid (such as an ink) in the communication channel can be visually observed.

Further, by making the applying part colored translucent, an application liquid can be visually viewed, as well as, following effects (i) or (ii) can be attained.

(i) When the applying part has a same color as that of an application liquid, the color of the application liquid can be easily judged.

(ii) When the applying part has a different color from that of an application liquid, it serves as means for displaying an element other than the color of the application liquid (for example, in the case of a lip cream, displaying whether it is in a under-color series or in a top-coat color series). Moreover, by providing a color with a high contrast ratio to the liquid color, it is possible to emphasize the liquid color and improve the color display performance.

Effect of the Invention

According to a liquid applicator of the present invention, an applying part made of an elastic material is formed with a communication channel for connecting the inside and the outside of a main body, and is provided with an application portion so as to further protrude to a front end from an ejection port of the communication path, wherein the application portion has a vertical-direction repulsion force of 0.01 to 1.4 (N) at a portion 3 (mm) from the front end, and thereby an excellent operative effect that the applying part is provided so as to have an excellent usability and no application unevenness, can be obtained.

In the present invention, the application portion of the applying part is provided so that a portion 3 (mm) from the front end thereof has a vertical-direction repulsion force of 0.01 to 0.70 (N), and thereby it is possible to provide an applying part having further excellent usability and less application unevenness. In particular, when the application liquid has viscosity in the range of 1,000 (mPs) to 100,000 (mPs), an applying part having no application unevenness and excellent application characteristics can be provided.

Further, in the present invention, in the application portion of the applying part, when exceeding conditions that a distance L from the ejection port to the front end is in a dimension range of $1 \leqq L \leqq 20$ (mm) and a width W from the ejection port to the front end is within a dimension range of $2 \leqq W \leqq 20$ (mm), it is difficult to perform application to a surface of a target object, and, by contraries, when being within the conditions, the application characteristics become excellent. It is desired that the width and the length of the applying part are appropriately selected within the above conditions.

Further, in the present invention, the applying part is made of a transparent or translucent material so that the application liquid in the communication channel can be visually observed, resulting that even when the application liquid tank in the main body can not be observed, the color of the application liquid supplied to the applying part can be observed by seeing through the transparent or translucent applying part. Moreover, it is possible to visually confirm the state of the application liquid being fed and prevent overfeed of the application liquid at the start of use.

BRIEF DESCRIPTION OF THE DRAWINGS

FIG. 5 is a view illustrating an example of measurement result in feeling of use and application unevenness in the comparative examples 1 to 2 and examples 1 to 9;

EXPLANATIONS OF NUMERALS

Figure 1:
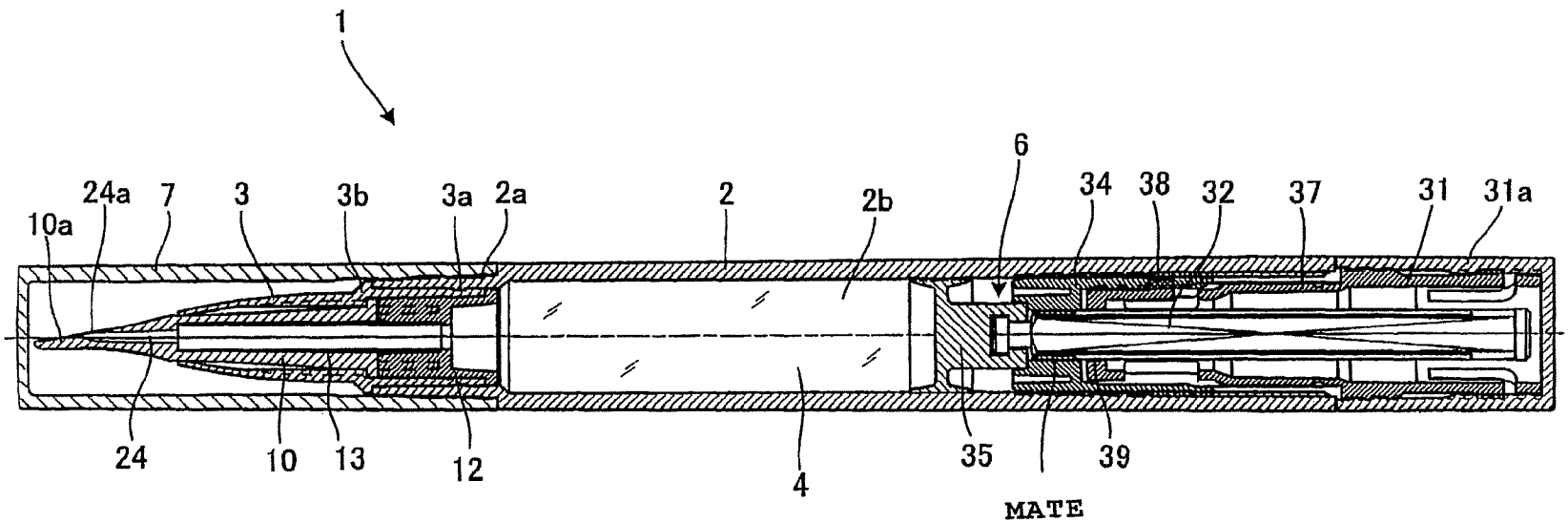
FIG. 1 is an example of embodiments for carrying out a liquid applicator according to the present invention, and shows a vertical overall sectional view of a liquid applicator according to an embodiment 1.

1 liquid applicator
2 main body
2*a* small-diametric portion in a main body
2*b* application liquid reservoir space
3 front barrel
3*a* fitting recess
3*b* flange
4 application liquid
6 liquid pressing mechanism
7 cap
10 applying part
10A to 10H applying parts
10*a* application portion
12 pipe joint
13 pipe part
21 upper-face taper portion
22 lower-face taper portion
23 shoulder portion
24 communication channel
24*a* ejection port
25 flat portion
31 rotary operation member
32 barrel member
34 screw part
35 piston part
37 advance part
38 engaging portion
39 engagement portion
40 force gauge
40*a* detection edge
40*b* display portion
42 non-absorbent surface
44 bulk
46 outer barrel
46*a* rear-end opening
46*b* front-end opening
47 liquid introducing pipe
48 inner barrel
48*a* male thread
48*b* tank
49 front barrel
50 pipe
51 sealing ring
52 agitation ball
53 spring receiver
53*a* window
54 valve rod
54*a* piston vane
55 valve spring
56 valve seat

56*a* valve port
57 inner front barrel
58 sealing part
60 tube part
60*b* tube part front end
60*c* application liquid reservoir space
61 front barrel
62 liquid introducing pipe
63 pipe
61 sealing ring

DESCRIPTION OF PREFERRED EMBODIMENTS

Now, referring to the accompanying drawings, preferred embodiments of the present invention will hereinafter be described.

FIGS. 1 to 16 are illustrative diagrams of each example of embodiments of a liquid applicator according to the present invention, where parts to which same reference numerals are given represent same parts.

Figure 2:
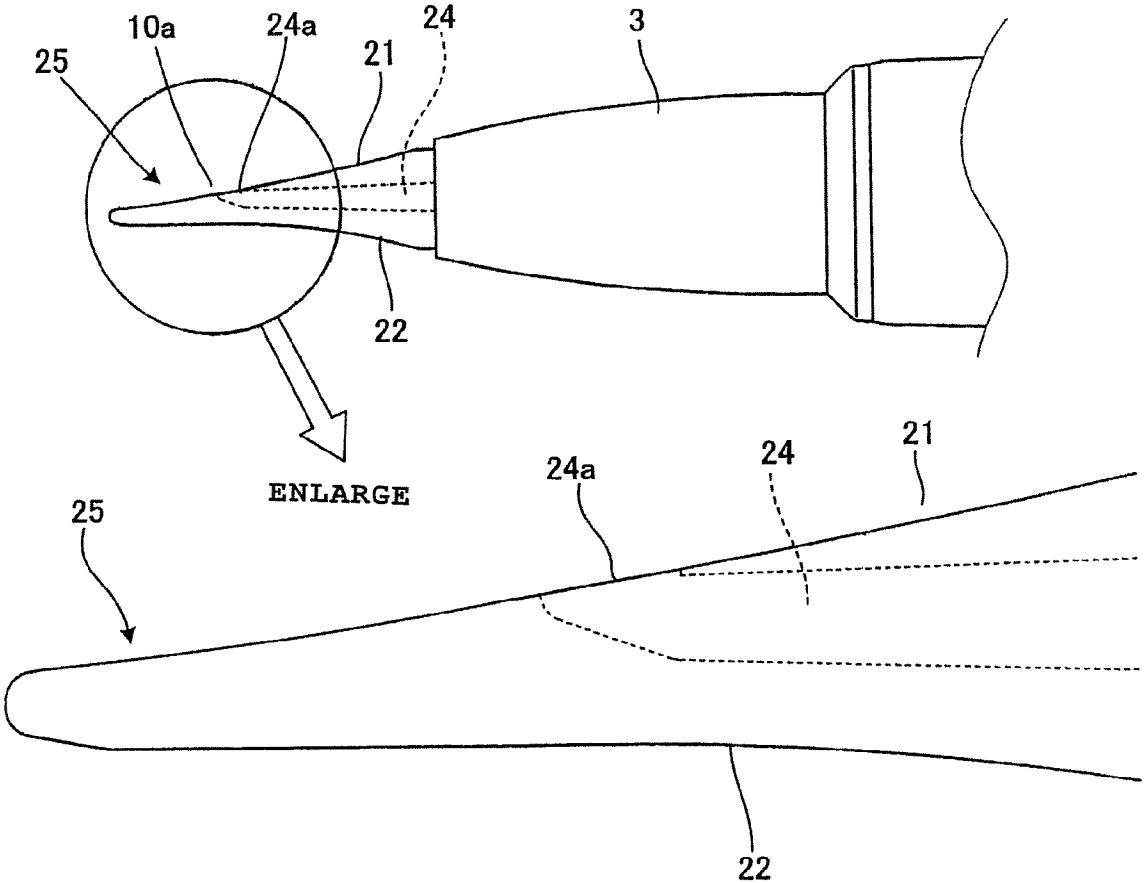
FIG. 2 is a detailed illustrative view of an applying part according to the embodiment.

FIG. 1 is an overall view of a liquid applicator according to an embodiment 1, and FIG. 2 is a detailed illustrative view of an applying part.

As shown in FIG. 1, a liquid applicator 1 according to the embodiment 1 is provided with a liquid pressing mechanism (liquid pressing means) 6 for pressurizing an application liquid 4 within a main body 2, and in the liquid applicator 1 which is provided so that the application liquid 4 is supplied to an applying part 10 at the front end of the main body by pressing of the liquid pressing mechanism 6, the applying part 10 is made of an elastic material, is formed with a communication channel 24 for connecting the inside and the outside of the main body, and is provided with an application portion 10*a* so as to further protrude toward the front end from an ejection port 24*a* of the communication channel 24, and the application portion 10*a* has vertical-direction repulsion force of 0.01 to 1.40 (N) at a portion 3 mm from the front end.

In the application portion 10*a* of the applying part 10, a distance L from the ejection port 24*a* to the front end is within a dimension range of $1 \leqq L \leqq 20$ (mm), and a width W from the ejection port 24*a* to the front end is within a dimension range of $2 \leqq W \leqq 20$ (mm).

Moreover, the applying part 10 is made of a transparent or translucent material so that ink in the communication channel 24 can be visually observed.

Further, detailed description will be made.

As shown in FIGS. 1 and 2, the liquid applicator 1 according to the embodiment is provided with the applying part 10 at the front end of the cylindrical main body 2, wherein the application liquid 4 stored in the reservoir space (reservoir tank) 2*b* within the main body 2 is pressurized by the liquid pressing mechanism 6 attached to the main body so that the application liquid 4 is supplied to the applying part 10 at the front end. Note that, in the liquid applicator 1, it is also possible the liquid pressing mechanism 6 is added with, a function of capable of depressurizing so as to be a liquid pressurizing/depressurizing mechanism, by which the application liquid 4 can be selectively pushed out and returned.

In addition, in the liquid applicator 1, the liquid pressing mechanism 6 has a piston part 35 for reducing and increasing the volume in the reservoir space by moving back and forth toward the application liquid reservoir space 2*b* within the main body 2, and a driving mechanism (composed of a rotary operation member 31, a barrel member 32, a screw part 34, an advance part and the like) for engaging a front portion of the barrel member (referred to also as "the thread rod") 32 with a rear portion of the piston part 35 so that the piston part 35 is caused to advance and retreat by moving the barrel member 32 back and force with operation force of a user.

Specifically, as shown in FIG. 1, the liquid applicator 1 is constituted by the outer cylindrical main body 2, a front barrel 3, the application liquid 4, the liquid pressing mechanism 6, a cap 7, and the applying part 10, as main members.

The applying part 10 is molded with an elastic resin material, such as a rubber, an elastomer, or closed-cell foam objects, so as to be able to obtain required application characteristics, and members other than the applying part 10 are set so as to have a density and rigidity capable of obtaining required hermetic performance and supporting performance, and are made of a resinous material or a metalic material.

In the main body 2 which has substantially cylindrical shape, a tapered small-diametric portion 2*a* of the main body is formed at the front end thereof, and the cap 7 is mated with the small-diametric portion 2*a* of the main body so as to be attachable and detachable. A space portion surrounded by a rear end of the front barrel 3 and the piston part 35 within the main body 2 serves as the application liquid reservoir space (ink tank) 2*b*. The piston part 35 is moved back and forth within the main body 2 by the liquid pressing mechanism 6, and thereby the volume in the application liquid reservoir space 2*b* is reduced and the pressure is increased so that the application liquid 4 is fed out in a direction of the application part.

The liquid pressing mechanism 6 is constituted by the rotary operation member 31, the barrel member 32, the screw part 34 of the barrel member 32, and the aforementioned piston part 35, as main members. The rotary operation member 31 (in which a front end of the advance part 37 is fitted into the rear end of the main body 2 and a cylindrical knob 31*a* for operation is fitted into the rear end of the advance part 37 so as to be able to relatively rotate with a rotating force not less than a predetermined rotating force) is provided in the main body 2 so as to be rotatable entirely, and the annular screw part 34 is provided in the main body 2 so as not to be rotatable. An engaging portion 38 of the screw part 34 and the rotary operation member 31 (the advance part 37) is formed with a toothed ratchet, and rotation is regulated so that the rotary operation member 31 rotates in only one direction with respect to the screw part 34. Moreover, in the case of serving as the pressurizing/depressurizing mechanism, the rotation regulation is not performed so as to produce click feeling.

A male thread in an outer periphery of the barrel member 32 is fitted, with a female thread which is formed at a center hole of the screw part 34. Moreover, the barrel member 32 has a dissimilar cam shape in a cross-sectional view, a center hole at an engagement portion 39 of the advance part 37 in the rotary operation member 31 is formed into a dissimilar cam shape corresponding to the outer periphery of the barrel member 32, and the barrel member 32 is inserted into the center hole of the engagement portion 39 so that barrel member 32 is slidable and relatively unrotatable in an axial direction with respect to the rotary operation member 31. The front end of the barrel member 32 is joined to the piston part 35, and when being rotated in a predetermined direction of the rotary operation member (a right rotating direction in the embodiment), the barrel member 32 advances with the piston part 35 by way of the screw part 34 toward the direction of the front end of the main body 2, and the application liquid 4 within (the application liquid reservoir space 2*b* of) the main body 2 is pressurized by the advance of the piston part 35 to be fed to the applying part 10.

[Front Barrel 3]

As shown in FIG. 1, the front barrel 3 is formed so as to have a cylindrical structure where the diameter is reduced to taper, and the applying part 10 is stored in the internal space which is opened in its front and rear in a state where the front end thereof is being protruded and fixed to the main body 2 in this storage state.

An annular fitting recess 3*a* which is formed on the outer periphery in the rear part of the front barrel 3 is press fitted into a fitting projection which is formed on the inner surface of a small-diametric portion of the main body 2*a* so as to prevent the front barrel 3 from dropping off from the main body 2. Moreover, a flange 3*b* on the outer periphery of the front barrel 3 abuts the front end face of the small-diametric portion of the main body 2*a*. In addition, a pipe joint 12 is fitted into the inside of the rear part of the front barrel 3, and the front end of the pipe joint 12 and the step part inside the front barrel holds a flange-like portion in the rear end of the applying part 10 therebetween so as to position the applying part 10. A hollow pipe part 13 is fitted from the hollow inner peripheral part of the pipe joint 12 into the hollow part of the applying part 10, and the front end of the hollow part in the applying part 10 is connected to the communication channel 24.

[Applying Part 10]

The applying part 10 of the liquid applicator 1 is made of an elastic material, and as shown in FIGS. 1 to 2, the applying part 10 is formed with the communication channel 24 for connecting the inside of the main body 2 and the outside, and when the application liquid 4 is pressurized by the liquid pressing mechanism 6, the application liquid is fed from the pipe joint 12 and the pipe part 13 through the communication channel 24 to the application portion 10*a*.

In the applying part 10, the front end which protrudes from the frontward of the front barrel 3 to be exposed has both-sided (upper-face and lower-face) taper portions 21 and 22 with a flat and tapered shape. The ejection port 24*a* of the communication channel 24 is opened in the upper-face taper portion 21. The application portion 10*a* of the applying part 10 is provided so as to further protrude toward the front end from the ejection port 24*a* of the communication channel 24.

In the present invention, the applying part 10 may be an elastic body as a whole, or only the application portion 10*a* may be constituted by an elastic body. As the material of the application portion 10*a*, a material which is made of an elastic material, including elastic materials such as a rubber and an elastomer, can be mentioned. Moreover, as the material of the application portion 10*a*, any elastic body having no open cell can be used as long as it has liquid tightness.

Examples thereof include:

(1) a rubber such as an NBR, a silicone rubber, an EPDM, a fluorosilicone rubber, a fluororubber, a urethane rubber, a natural rubber, a chloroprene rubber, a butadiene rubber, and a butyl rubber;

(2) an elastomer such as a styrene based elastomer, a vinyl chloride-based elastomer, an olefin-based elastomer, an polyamide-based elastomer, a polyamide-based elastomer, a urethane-based elastomer; and (3) a closed-cell foam such as a polyethylene foam, a vinyl chloride foam, and a polystyrene foam.

As shown in FIG. 2 in detail, in the applying part 10, the application portion 10*a* is a portion which extends further frontward from the opening position of the ejection port 24*a*, and is formed as a flat portion 25. The communication channel 24 extends straightly in the axial direction from the front barrel 3 and is bent into a "projected V-shape" in the side of the upper-face taper portion 21 in the vicinity of the upper-face taper portion 21 to be exposed, and the ejection port 24*a* is opened. The communication channel 24 and the ejection port 24*a* have a semicircular cross sectional shape.

In the liquid applicator 1 in a normal using state, when a user operates the liquid pressing mechanism 6 in a state where the applying part 10 is directed downward or to a lateral direction, the application liquid 4 in the application liquid reservoir space 2*b* is pressurized. With the pressure, the application liquid 4 is ejected from the ejection port 24*a* of the communication channel 24. The ejected application liquid 4 is once ejected to the side of the upper-face taper portion 21, and flows to the side of the flat portion 25 to be held in the flat portion 25 temporarily. The holding amount of the application liquid 4 in the flat portion 25 depends on a kind of cosmetics used.

Then, the user presses the flat portion 25 with appropriate pressing force to an objective portion being desired to be applied, so as to apply the application liquid.

Moreover, the applying part 10 is made of a transparent or colored translucent material so that ink in the communication channel 24 can be visually observed.

Next, functions of the aforementioned embodiment will be described.

[Feeling of Use and Application Characteristics when Vertical-Direction Repulsion Force of the Applying Part is Set]

Figure 3:
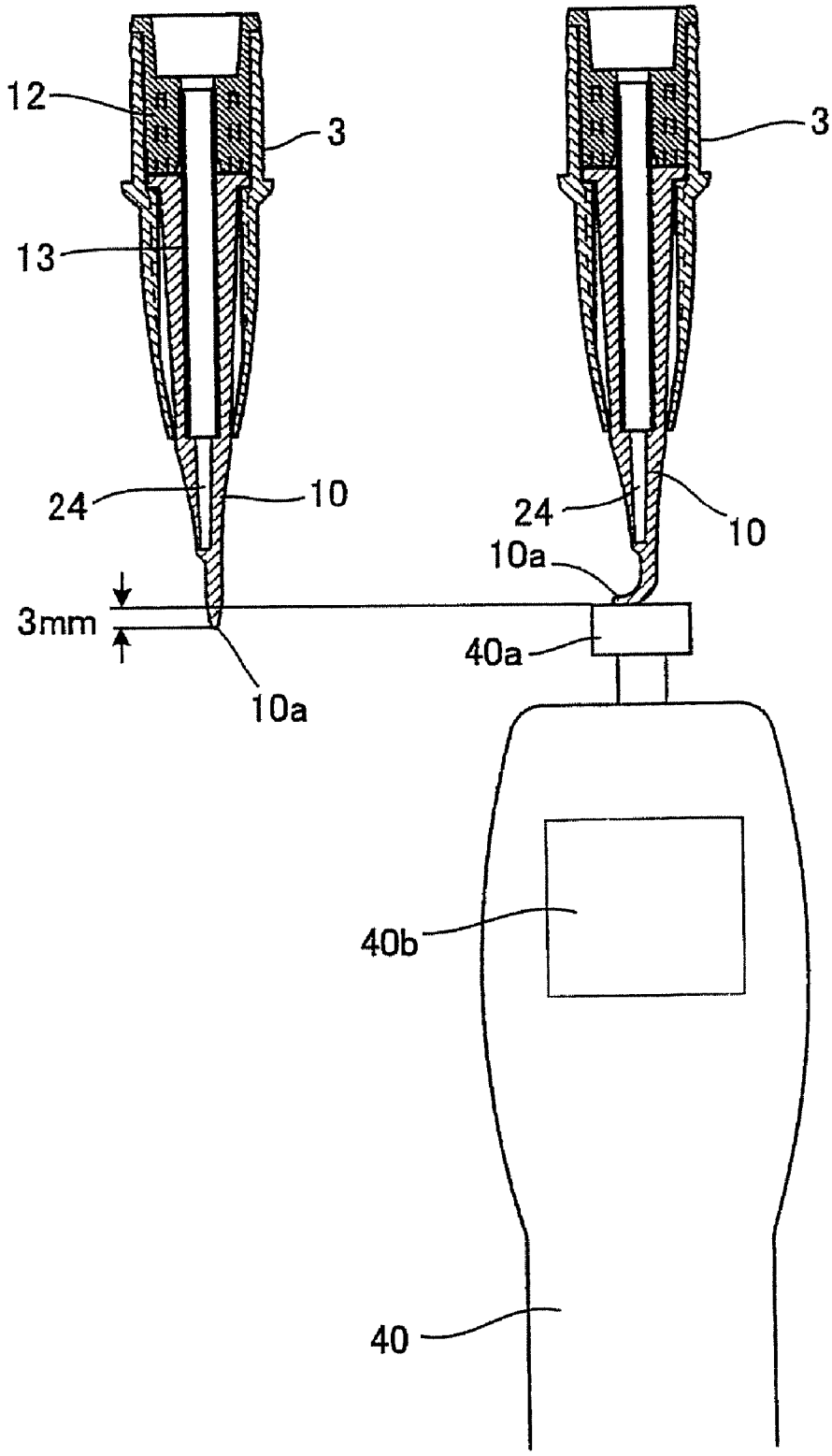
FIG. 3 is an illustrative view of setting repulsion force of the applying part.
Figure 4:
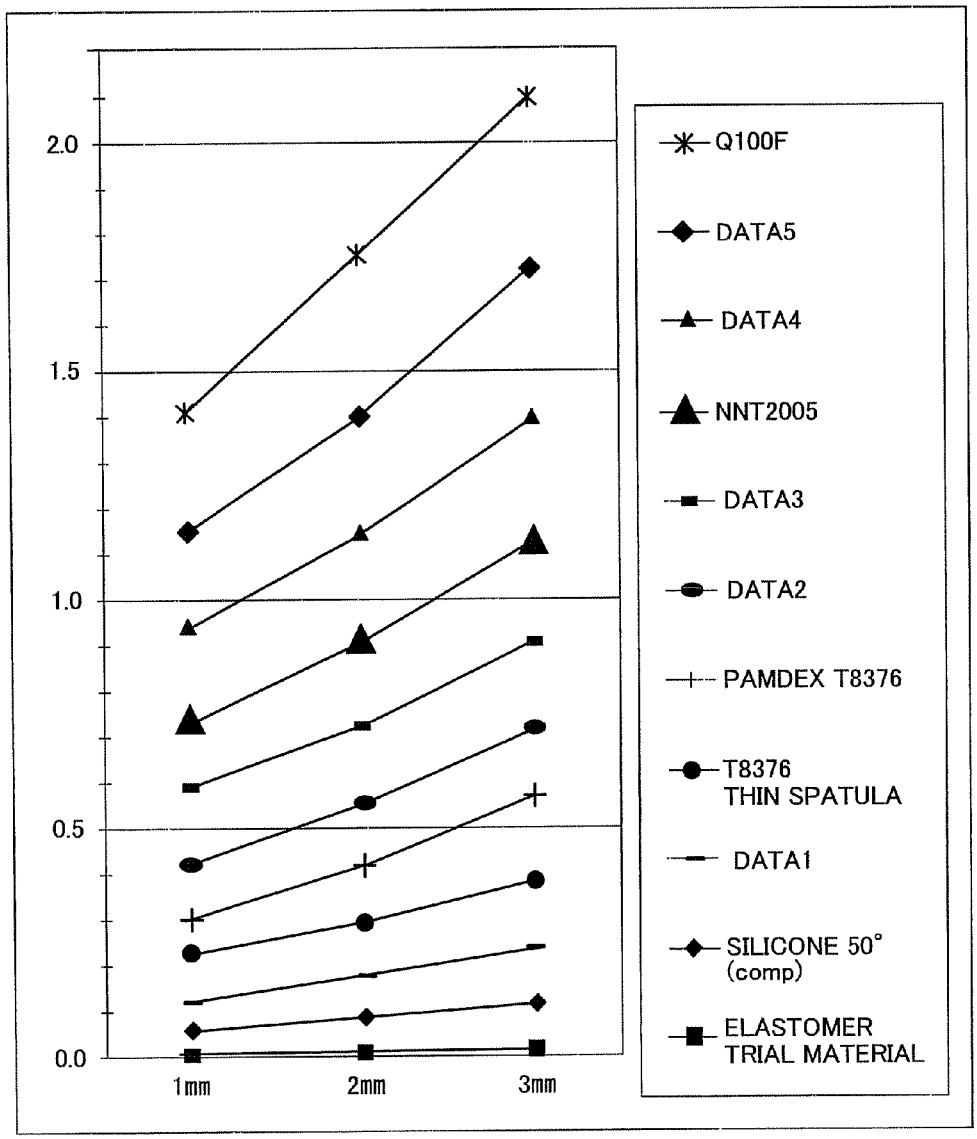
FIG. 4 is an illustrative view of measuring repulsion force in comparative examples 1 to 2, and examples 1 to 9 where various kinds of materials are used for the applying part.
Figure 6:
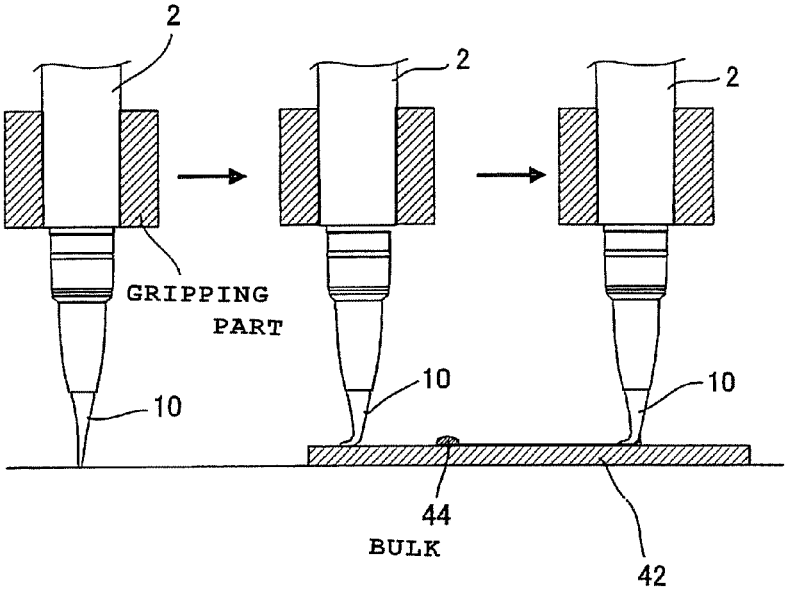
FIG. 6 is an illustrative view of a method for evaluating application unevenness.
Figure 7:
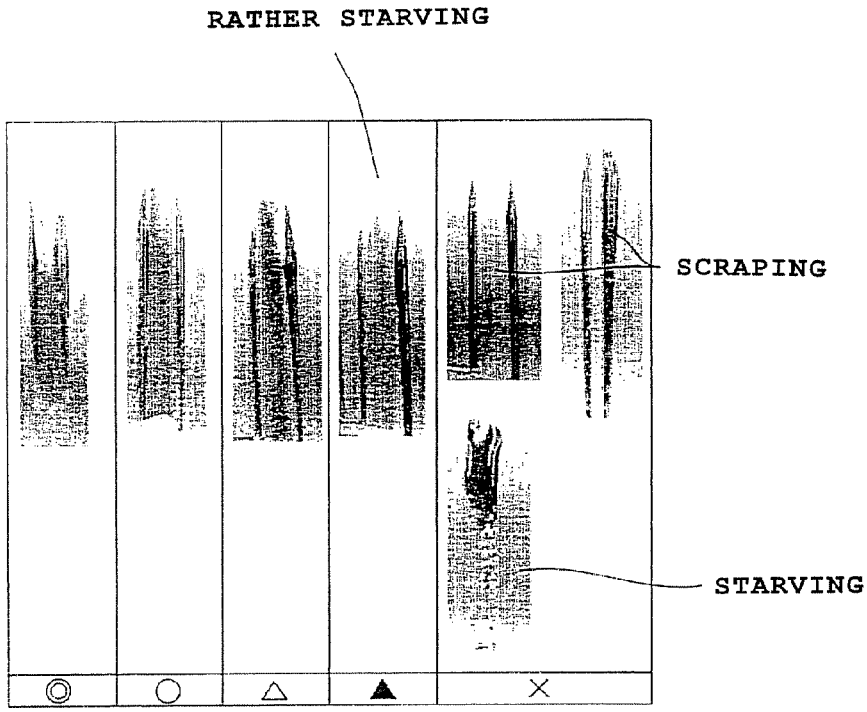
FIG. 7 is an illustrative view of a reference for evaluating application unevenness.
Figure 8:
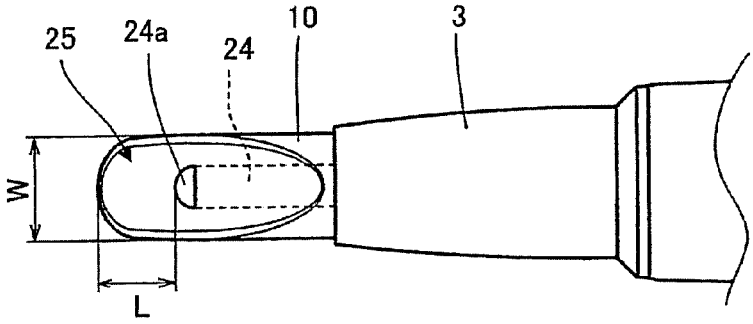
FIG. 8 is an illustrative view of a width W of the applying part and a length L of an application portion.
Figure 9:
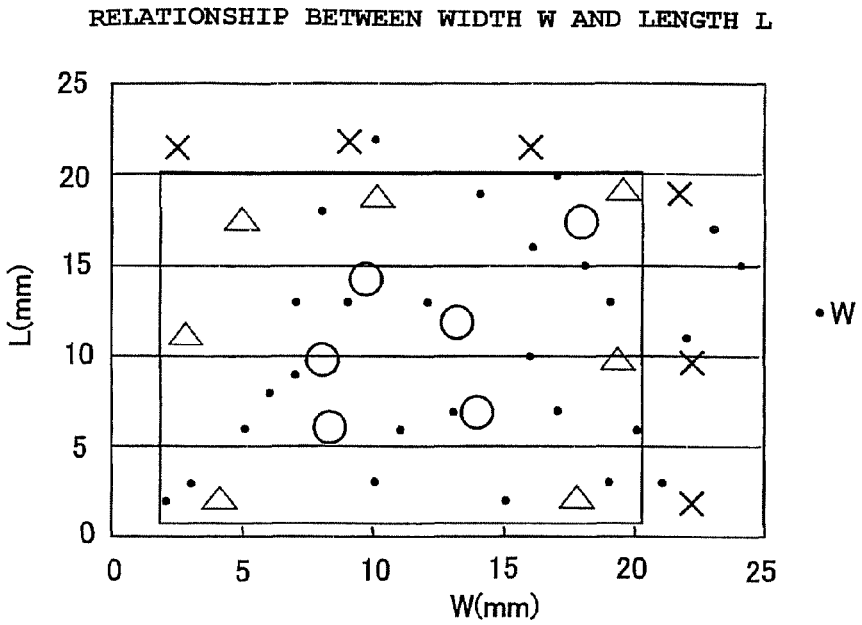
FIG. 9 is an illustrative view of an evaluation of application unevenness.

FIG. 3 is an illustrative view of setting repulsion force of the applying part 10, FIG. 4 is an illustrative view of measuring repulsion force in comparative examples 1 to 2 and examples 1 to 9 where various kinds of materials are used for the applying part 10, FIG. 5 is a view illustrating an example of measurement result in feeling of use and application unevenness in the comparative examples 1 to 2 and examples 1 to 9, FIG. 6 is an illustrative view of a method for evaluating application unevenness, FIG. 7 is an illustrative view of a reference for evaluating application unevenness, FIG. 8 is an illustrative view of a width W of the applying part and a length from an application portion, and FIG. 9 is an illustrative view of an evaluation, of application unevenness.

The applying part 10 of the embodiment is set so that the application portion 10*a* thereof has vertical-direction repulsion force of 0.01 to 1.40 (N) at a portion 3 mm from the front end thereof.

The repulsion force of the application portion 10*a* was, as shown in FIG. 3, detected by a force gauge 40. In the force gauge 40, a detection edge 40*a* with a tray retreats by the strength of applied force to detect the force (display a numeric value (N) on a display portion 40*b*).

Specifically, as shown in FIGS. 4 to 5, in the comparative examples 1 to 2 and the examples 1 to 9, each applying part was formed using each resin product (Q100F to an elastomer trial material) as a material.

With respect to the comparative examples 1 to 2 and the examples 1 to 9, as shown in FIG. 3, a portion 3 mm from the front end of the application portion is made contact with the detection edge 40*a* by sliding from a lateral direction (a vertical direction in advancing/retreating directions of the detection edge 40*a*), and under the state of which the force N that the application portion receives from the detection edge 40*a* was measured.

Note that, in each example, each applying part was created by changing a material (a shape) as well.

Comparative example 1: flexible polypropylene (flexible PP: trade name of Catalloy, and grade name of Q100F manufactured by SunAllomer Ltd., was used)

Comparative example 2: Data 5 (thermoplastic resin product)

Example 1: Data 4 (thermoplastic resin product)
Example 2: flexible polypropylene (flexible PP: trade name of Newcon, and grade name of NNT2005 manufactured by Japan Polypropylene Corporation was used)
Example 3: Data 3 (thermoplastic resin product)
Example 4: Data 2 (thermoplastic resin product)
Example 5: thermoplastic polyurethane (a kind of an elastomer resin: trade name of PANDEX, and grade name of T-8375 manufactured by DIC Bayer Polymer Ltd., was used)
Example 6: same material as that of the example 5 was used to mold into a spatula shape.
Example 7: Data 1 (thermoplastic resin product)
Example 8: a silicone material with hardness of 50 degrees (comp)
Example 9: elastomer trial material In data 1 to data 5, an inventor adjusted a thermoplastic resin product to create an applying part so that elastic force positioned between resin products used for each example is obtained in the force (N) applied from an application portion.

Results of measuring elastic force in the front end of an applying part which actually performs application are shown in FIGS. 4 to 5.

Moreover, evaluation was performed as to feeling of use and occurrence of application unevenness when application was actually performed in each example of these applying parts. The evaluation result will be shown in FIG. 5.

In the evaluation of feeling of use, a tester evaluated feeling of use by applying a bulk on the skin in each example of the applying parts. The evaluation in feeling of use shown in FIG. 5 includes "◎": good, "○": rather good, "Δ": normal, "▲": rather hard and a little inconvenient, and "x": hard and inconvenient.

Moreover, with respect to evaluation in occurrence of application unevenness for each viscosity, a test was carried out with the bulk of the application liquid having general viscosity (in a shear rate 5 ($sec^{-1}$) such as make-up cosmetic being mainly at 10,000 (mPs). The test was carried out with a viscosity range of 1,000 (mPs) being one-tenth of the viscosity and of 100,000 (mPs) being ten times of the viscosity.

In addition, in the evaluation test in application unevenness, as shown in FIG. 6, a bulk 44 was dropped on a non-absorbent surface 42 having a thickness of 3 (mm) and an applying part was moved along the non-absorbent surface at constant speed, and thereby the bulk is applied and spread by the applying part 10.

By observing the state of the bulk 44 thus applied and spread, the evaluation was performed with the five steps of "◎", "○", "Δ", "▲", and "x". The evaluation reference was, as shown in FIG. 7, from the evaluation of "◎": good (a state where an application liquid is applied and spread uniformly without any unevenness on an application surface) to the evaluation of "x": failure (a state where an application liquid on an application surface is scraped by an applying part and not spread at all). The evaluations of "○" to "▲" are middle level therebetween, and the evaluation was carried out depending on its degree.

Moreover, the applying part was moved at a higher speed (150 mm/sec) and at a lower speed (50 mm/sec).

As shown in FIG. 5, in the evaluation result of comparative examples 1 to 2, both evaluations were not good; feeling of use was hard and the application were not good for each viscosity.

On the other hand, in the example 1, although feeling of use was rather hard and a little application unevenness was occurred causing a little nonuniformity, no starving was occurred.

In the examples 2 to 9, feeling of use was in normal to good, and the application was in a little unevenness or no unevenness. Hence, in the present invention, the application portion is provided so that a portion 3 (mm) from the front end thereof has vertical-direction repulsion force of 0.01 to 1.4 (N), and thereby it is possible to provide an applying part having good usability and less application unevenness.

Particularly, in the examples 4 to 9, it is especially preferable since good application characteristics are provided, where feeling of use is good and no application unevenness occurs regardless of viscosity of an application liquid.

Thus, the application portion of the applying part is provided so that a portion 3 (mm) from the front end thereof has vertical-direction repulsion force of 0.01 to 0.70 (N), and thereby it is possible to provide an applying part with further good usability and less application unevenness. In particular, when the application liquid has viscosity in the range of 1,000 (mPs) to 100,000 (mPs), an applying part having no application unevenness and good application characteristics is provided.

[Application Characteristics by Setting a Dimension of an Application Portion of an Applying Part]

As shown in FIG. 8, in the application portion 10*a* of the applying part 10 in the embodiment, it is defined that a distance L from the ejection port 24*a* to the front end is in a dimension range of $1 \leqq L \leqq 20$ (mm), and a width W from the ejection port 24*a* to the front end is within a dimension range of $2 \leqq W \leqq 20$ (mm). The evaluation in this case is shown in FIG. 9.

When the width W and the length L of the application part 10*a* exceed the above ranges, it was difficult to perform application, and when being within the ranges, the application characteristics were good.

Note that, it is desired that the width W and the length L of the application part 10*a* are appropriately selected in accordance with application objects within the above ranges.

[Applying Part Made of a Transparent or Translucent Material]

In the embodiment, as shown in FIG. 2, the applying part 10 is made of a transparent or translucent material so that ink in the communication channel can be visually observed. It is more preferable to make translucent by coloring in a color different from that of an application liquid.

Accordingly, even when the application liquid in the main body can not be visually observed, the color of the application liquid supplied to the applying part can be viewed by seeing through the transparent or translucent applying part. Moreover, it is possible to visually confirm the state of the application liquid being fed and prevent overfeed of the application liquid at the start of use.

Next, modification examples of the embodiment will be described.

The applying part 10 of the liquid applicator in the aforementioned embodiment can be variously modified and carried out as the modification examples 1 to 8 shown in FIGS. 10 to 14 in addition to FIGS. 1 and 2. Further, the overall structure of the liquid applicator is same as that of the embodiment of FIGS. 1 to 2 and same reference numerals are given to same parts.

Figure 10A:
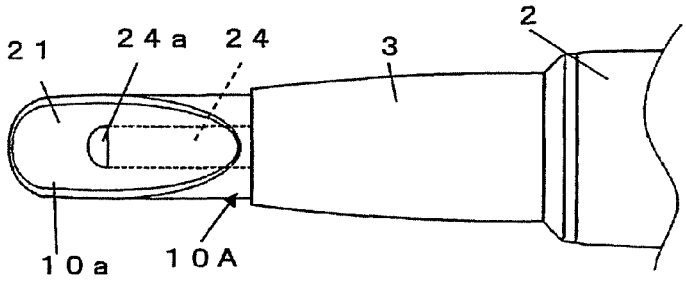
FIG. 10 is an illustrative view of a modification example 1 of the applying part of the liquid applicator, where (a) shows a side view when viewed from an upper-face taper portion side and (b) shows a side view of the taper portion.
Figure 10B:
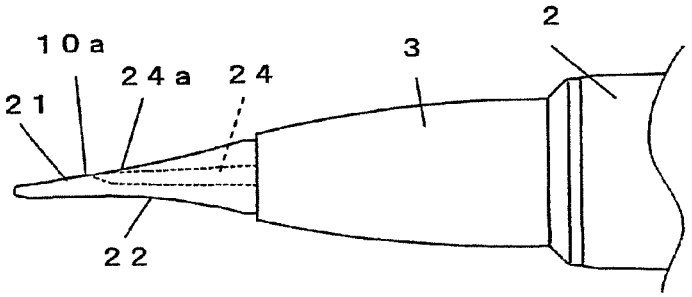

An applying part 10A according to the modification example 1 of FIG. 10 has the upper-face taper portion 21 having no steps, and is integrally formed flat from rearward of the ejection port 24*a* to the flat portion 25. The ejection port 24*a* is in an open state at all times.

Figure 11A:
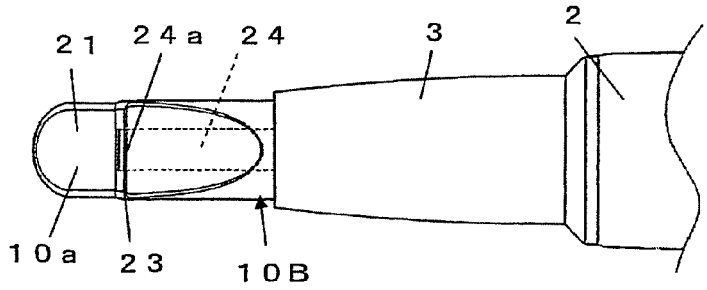
FIG. 11 is an illustrative view of a modification example 2 of the applying part of the liquid applicator, where (a) shows a side view when viewed from an upper-face taper portion side and (b) shows a side view of the taper portion.
Figure 11B:
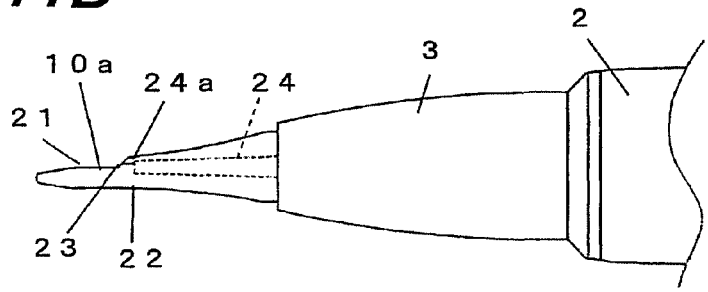

In an applying part 108 according to the modification example 2 of FIG. 11, the upper-face taper portion 21 is formed with a step by a shoulder portion 23 and the ejection port 24*a* is opened in the shoulder portion 23 as the step.

The shoulder portion 23 has an inclination angle larger than that of the upper-face taper portion 21 and is faced frontward.

In addition, the communication channel 24 extends straightly and frontward in an axial direction of the applying part 10, and is narrowed in a slit shape near the ejection port 24*a*. The slit-shaped part is usually narrow or closely contacting to be closed, and forms a valve mechanism which is opened when ejection pressure of the application liquid 4 rises. Since the applying part 10*a* is partitioned by the shoulder portion 23, the application liquid fed from the slit valve mechanism is concentrated into the applying part 10*a* and is difficult to escape, thus the application liquid can be applied without waste.

Figure 12A:
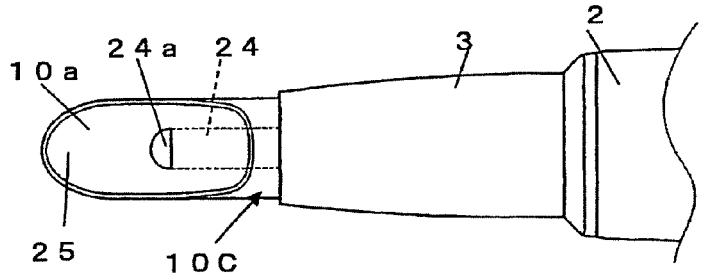
FIG. 12 is an illustrative view of a modification example 3 of the applying part of the liquid applicator, where (a) shows a side view when viewed from an upper-face taper portion side and (b) shows a side view of the taper portion.
Figure 12B:
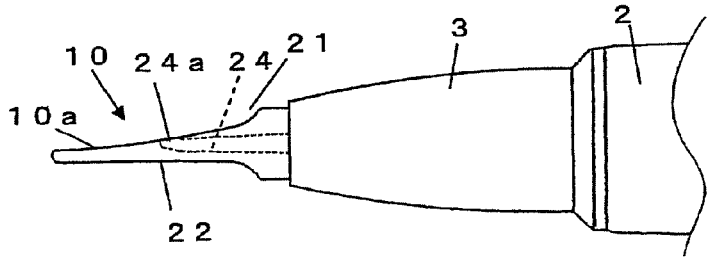

In an applying part 10C according to the modification example 3 of FIG. 12, although the upper-face taper portion 21 has no step, the upper-face taper portion 21 and the lower-face taper portion 22 get narrower as if being peeled off in a rear side near the front barrel 3 and, in the front therefrom, are integrally formed flat from rearward of the ejection port 24*a* to the flat portion 25. The ejection port 24*a* is in an open state at all times.

Figure 13A:
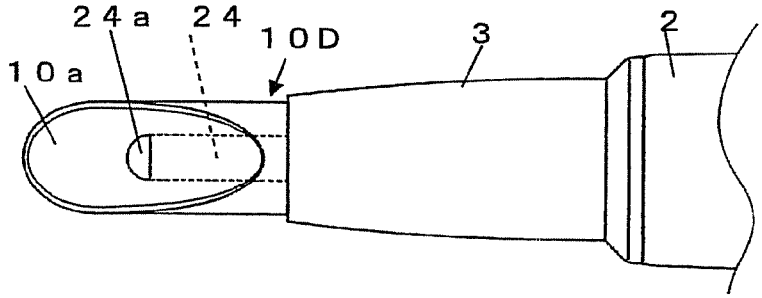
FIG. 13 is an illustrative view of a modification example 4 of the applying part of the liquid applicator, where (a) shows a side view a from an upper-face taper portion side and (b) shows a side view of the taper portion.
Figure 13B:
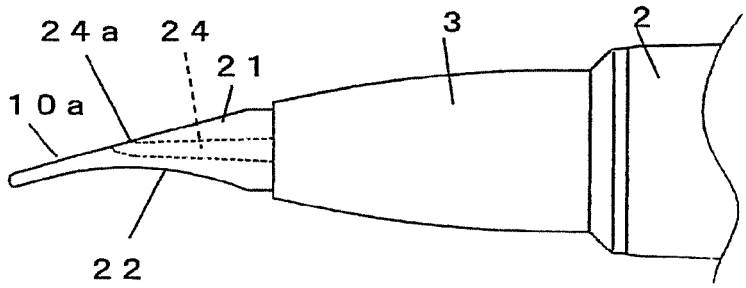
Figure 14A:
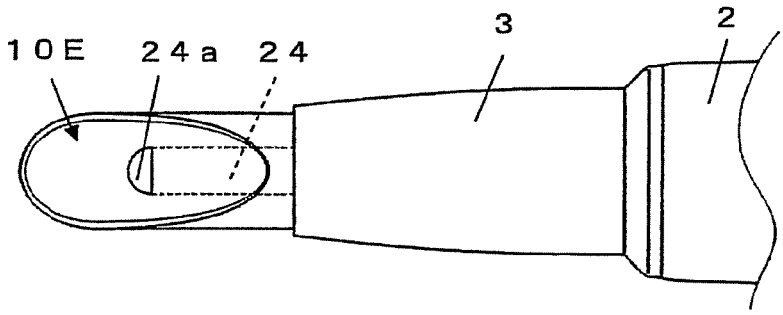
FIGS. 14(*a*) to (*d*) are illustrative views of modification examples 5 to 8 of the applying part of the liquid applicator, and each of which is a side view when viewed from an upper-face taper portion side.
Figure 14B:
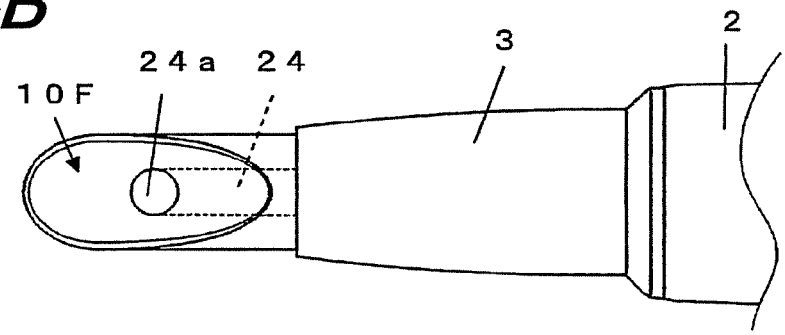
Figure 14C:
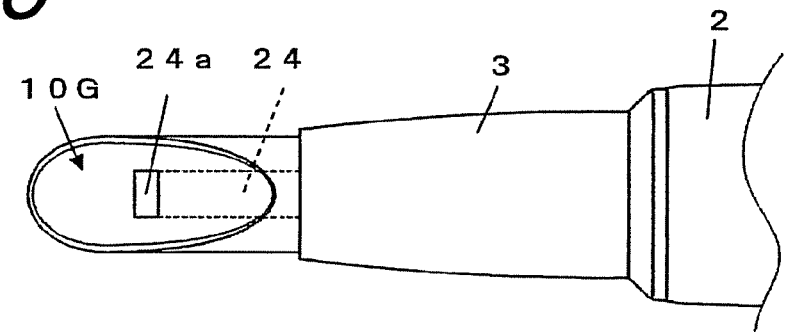
Figure 14D:
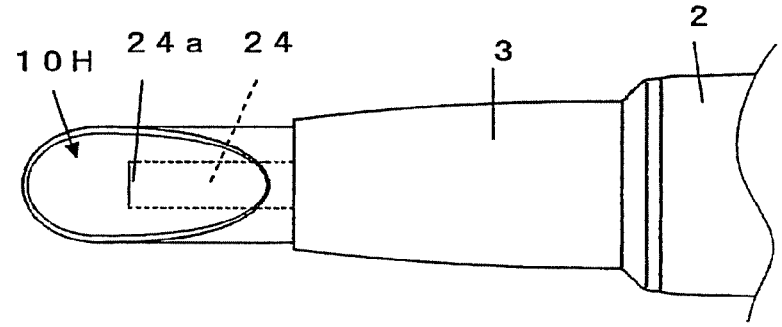

An applying part 10D according to the modification example 4 of FIG. 13 has the upper-face taper portion 21 having no steps and is integrally formed flat from rearward of the ejection port 24*a* to the flat portion 25, but the lower-face taper portion 22 is formed in an arc shape with lower ends opened, and the applying part 10 is warped downwardly as a whole from the rear to the front in aside view. The ejection port 24*a* is in an open state at all times.

In the applying part 10D according to the modification example 4, the application liquid 4 fed from the ejection port 24*a* remains including in the rear side and a larger quantity of application liquid than that of the aforementioned modification example 3 is easily held by the upper-face taper portion 21 and is also easily close-contacted and widely spread in a wide range from the base end to the front end of the applying part at the time of application for objective parts. Moreover, by setting the lower-face taper portion 22 as being in an arc shape, it is possible to obtain a milder elasticity in the whole of the applying part 10D.

FIGS. 14(*a*) to (*d*) are applying parts 10E to 10H according to the modification examples 5 to 8, which show each example where the ejection port 24*a* which is opened in the upper-face taper portion 21 is variously changed.

In the applying part 10E of the modification example 5 shown in FIG. 14(*a*), the ejection port 24*a* has a semicircular shape and an application liquid is easily fed frontward. In the applying part 10F of the modification example 6 shown in FIG. 14(*b*), the ejection port 24*a* has a circular shape and an application liquid is easily fed frontward and rearward. The applying part 10G of the modification example 7 shown in FIG. 14(*c*) has the ejection portion 24*a* in a rectangular shape. Moreover, in the applying part 10H of the modification example 8 shown in FIG. 14(*d*), the ejection port 24*a* is formed with a slit, is opened with a pressure by elastic force of the applying part 10G, and is closed when there is no pressure or pressure is reduced, thus making it possible to prevent that undesirable substances such as external dirt and various germs are mixed in the application liquid 4 in the communication channel 24 and the application liquid reservoir space 2*b*.

In these embodiments, although the communication channel 24 is bent into a "projected V-shape" to the upper-face taper portion 21 in the vicinity of the upper-face taper portion 21, it is also possible to extend the communication channel 24 straightly in an axial direction to form the ejection port 24*a*.

Other embodiments will be described.

Figure 15:
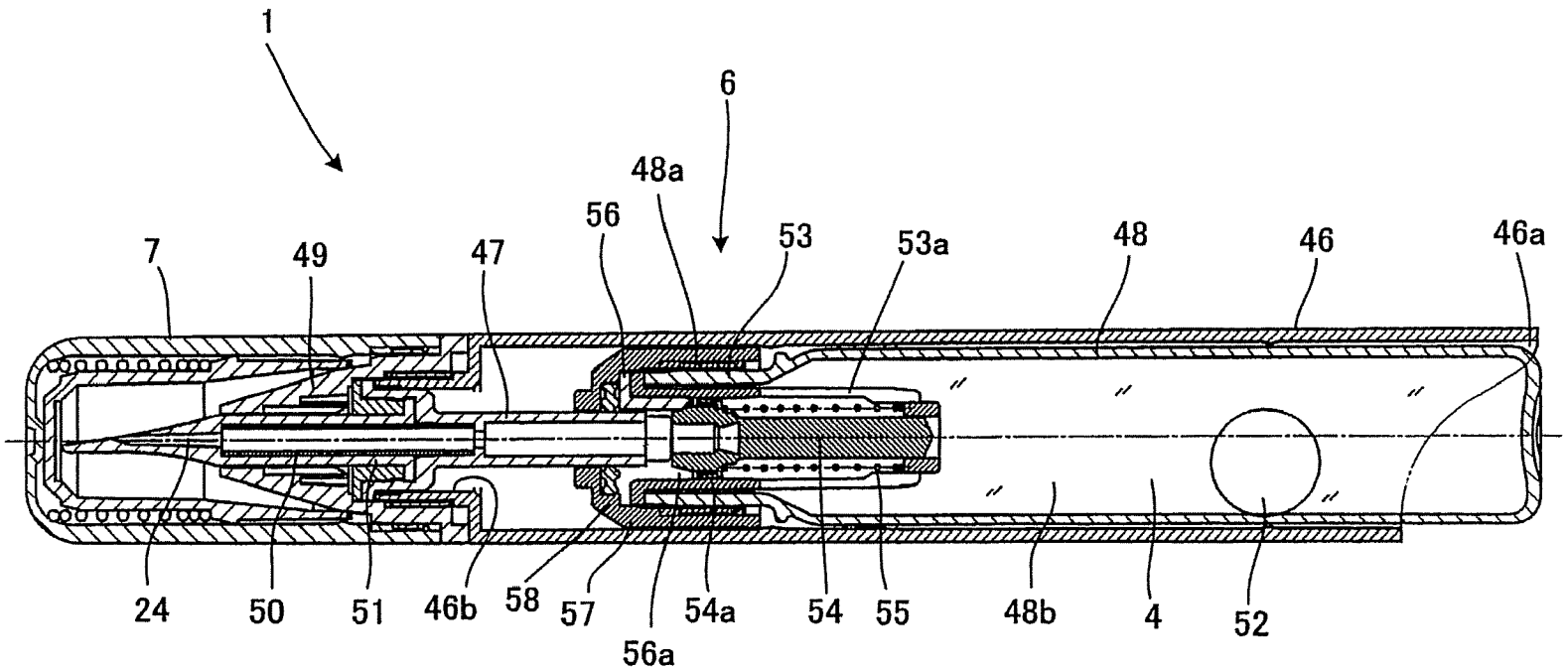
FIG. 15 is a vertical overall sectional view of a liquid applicator according to an embodiment 2 of the present invention.
Figure 16:
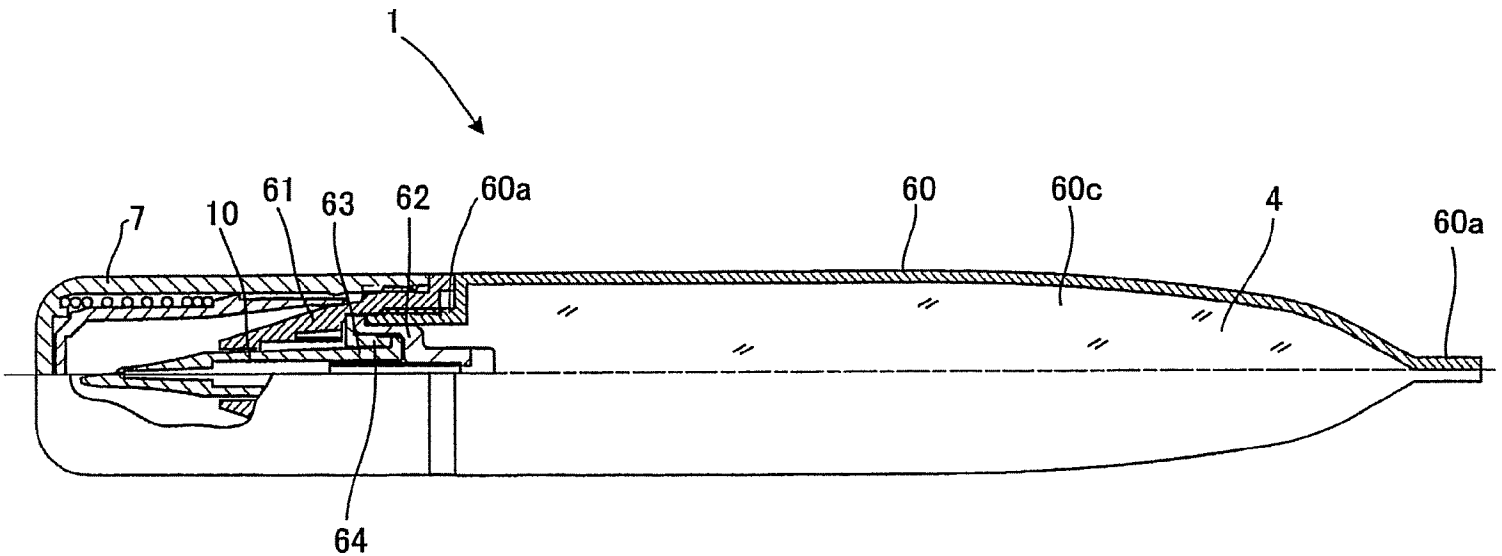
FIG. 16 is a vertical overall sectional view of a liquid applicator according to an embodiment 3 of the present invention.

FIGS. 15 to 16 are embodiments 2 to 3 in which the liquid pressing mechanism 6 of the liquid applicator of the embodiment is changed. Note that, same reference numerals are given to same parts as those of embodiments in the aforementioned FIGS. 1 to 2. In addition, the applying parts 10A to 10H according to the modification examples 1 to 8 shown in FIGS. 10 to 14 can be employed as the applying part 10 of the embodiments 2 to 3.

In the liquid applicator according to the embodiment 2 shown in FIG. 15, an introducing path for an application liquid is opened and closed in the main body 2 for storing the application liquid 4 therein, and the valve-type liquid pressing mechanism (referred to also as the valve device) 6 for pushing out the application liquid toward the applying part 10 is incorporated.

The main body 2 is provided with an outer barrel 46 in which both of front and rear ends are opened; a liquid introducing pipe 47 which is press fitted into a front end of the outer barrel 46 in a water-tight state; an inner barrel 48 which stores an application liquid, is disposed so as to be movable in an axial direction within the outer barrel 46, and is mated with a rear part of the liquid introducing pipe 47 so as to be slidable in a water-tight state; the liquid pressing mechanism (the valve device) 6 which is incorporated in a front part of the inner barrel 48, and pushes out the application liquid in the inner barrel 48 toward the liquid introducing pipe 47 by opening a valve when the inner barrel 48 is clicked in an axial direction from the side of a rear-end opening 46*a* of the outer barrel 46; a front barrel 49 which is fitted in the outer side of the liquid introducing pipe 47, and is fixed to an outer periphery of a front-end opening 46*b* of the outer barrel 46 so as to fasten the liquid introducing pipe 47 in an axial direction; and a pipe 50 in which, in a state where a front end of the applying part 10 is exposed from the front barrel 49, a front end is connected to the communication channel 24 and a rear end is press fitted into the front end of the liquid introducing pipe 47 in a water-tight state, wherein a flange-shaped portion of a rear end in the applying part 10 is fixed by threading the front barrel 49 to a front end of the outer barrel 46 by interposing a sealing ring 51.

The inner barrel 48 is formed into a cylindrical shape with a bottom, and is made of a tank 48*b* in which a substantially cylindrical application liquid reservoir space extending rearward from a rear end of a male thread 48*a* in a front end is formed. In the tank 48*b*, the predetermined application liquid 4 and an agitation ball 52 for agitating the same are stored.

The liquid pressing mechanism 6 is provided with a spring receiver 53 which is press fitted into an inner periphery of the male thread 48*a* in the inner barrel 48, and has a window 53*a* on a peripheral wall; a valve rod 54 including a piston vane 54*a* which has a rear end supported slidably in a water-tight state by a rear end of the spring receiver 53, and slidingly contacts with an inner periphery of the spring receiver 53 in the vicinity of a front end of the window 53*a*; a valve spring 55 which urges the valve rod 54 forward in the spring receiver 53; and a valve seat 56 including a valve port 56*a* being press fitted into an inner periphery of the spring receiver 53, in which a front end of the valve spring 55 comes into contact therewith so as to be attachable and detachable.

The spring receiver 53 and the valve seat 56 are fastened in an axial direction by an inner front barrel 57 which is threaded to the male thread 48*a* of the inner barrel 48, and the inner front barrel 57 and the valve seat 56 are fitted with the outer periphery of the liquid introducing pipe 47 so as to be movable in an axial direction through a ring-shaped sealing part 58 which is sandwiched therebetween. Note that, the cap 7 is fit on the front barrel 3 to cover the applying part 10 at a time of nonuse.

When a user clicks a rear end of the inner barrel 48 upon using, it is possible that the liquid pressing mechanism 6 feeds an appropriate amount of the application liquid 4 in the tank 48*b* to the applying part 10 through the pipe 50 from the liquid introducing pipe 47.

Further, FIG. 16 is a vertical sectional view of the liquid applicator according to the embodiment 3.

In the liquid applicator shown in FIG. 16, the liquid pressing mechanism 6 is made of a tube part 60, the tube part 60 is a hollow cylindrical package in which a flexible thin film body which is made of a resinous material or a metallic material is made a single layer or is layered (laminate etc.), a rear end 60*a* is closed by welding or adhering, and the applying part 10 is fixed by a front barrel 61 into which a tube part front end 60*b* which is cylindrically protruded and opened is screwed. The inside of the tube part 60 serves as an application liquid reservoir space 60*c* in which the application liquid 4 is injected and stored from a front end, and by reducing the internal volume of the tube part 60, the application liquid 4 can be pushed out from the front end 60*b* side.

Specifically, in the liquid applicator according to the embodiment 3, the tube part front end 60*b* is provided with a liquid introducing pipe 62 which is press fitted in a water-tight state; the front barrel 61 which is fitted in the outer side of the liquid introducing pipe 62, and is fixed to an outer periphery of a front-end opening of the tube part front end 60*b* so as to fasten the liquid introducing pipe 62 in an axial direction; and a pipe 63 in which, in a state where the front end of the applying part 10 is exposed from the front barrel 61, a front end is connected to the communication channel 24 and a rear end is press fitted into the front end of the liquid introducing pipe 62 in a water-tight state, wherein a flange-shaped portion of the rear end in the applying part 10 is fixed by threading the front barrel 61 to the tube part front end 60*b* by interposing a sealing ring 64.

According to the embodiment 3, when a user nips the tube part 60 with fingers to reduce the inner volume, it is possible to feed an appropriate amount of the application liquid from the tube part front end 60*b* serving as the liquid pressing mechanism 6 to the applying part 10 through the liquid introducing pipe 62 and the pipe 63. It is possible to apply the application liquid by touching the applying part 10 to a desired part.

Note that, in these embodiments, the pipe 63 is not always necessary depending on the viscosity of the application liquid and the hardness of the applying part.

INDUSTRIAL APPLICABILITY

A liquid applicator of the present invention is used as a liquid applicator for applying an application liquid such as cosmetics and a chemical liquid to a soft object such as skin and oral cavity, thus it is possible to provide a liquid applicator having no application unevenness and good application property.

What is claimed is:

1. A liquid applicator comprising:

a cylindrical main body;

an applying part provided at front end of said cylindrical main body; and a cap covering at least said applying part, wherein said cylindrical main body is provided with an application liquid reservoir space for storing an application liquid having viscosity in the range of 1,000 (mPs) to 100,000 (mPs), and a liquid pressing means for pressing said application liquid within the main body, so as to supply the application liquid to the applying part provided at the front end of the main body by pressing of said liquid pressing means, wherein the applying part is made of an elastic material, formed with a communication channel for connecting the inside of the main body and the outside, and an application portion of the applying part is provided so as to further protrude toward the front end from an ejection port of the communication channel, wherein a front end of the applying part including the application portion has a flat and tapered shape, wherein said election port is disposed approximately upward in normally opening state in an approximately central portion of said flat application portion, wherein in the applying part a distance L from said election port to the front end is within a dimension range of $1<L<20$ (mm), and a width W of the central portion of the applying part is within a dimension range of $2<W<20$ (mm), and the front end of said applying part when being bent by pressure from the vertical plane into the horizontal plane comprising a vertical-direction repulsion force of 0.01 to 1.40 (N) at a portion of 3 (mm) from the front end, wherein the vertical-direction repulsion force is measured by bringing a portion 3 mm from the front end of the application portion in contact with the detection edge by sliding from a lateral direction, and under the state of which the force N that the application portion receives from the detection edge is measured.

2. The liquid applicator according to claim 1, wherein the applying part is made of a transparent or translucent material so that an ink in the communication channel is visually observed.

* * * * *